US010711738B2

(12) United States Patent
Oshita et al.

(10) Patent No.: US 10,711,738 B2
(45) Date of Patent: Jul. 14, 2020

(54) ELECTRIC SUPERCHARGER

(71) Applicant: KABUSHIKI KAISHA TOYOTA JIDOSHOKKI, Kariya-shi, Aichi-ken (JP)

(72) Inventors: Makio Oshita, Aichi-ken (JP); Toshihiro Yamamichi, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 253 days.

(21) Appl. No.: 15/808,946

(22) Filed: Nov. 10, 2017

(65) Prior Publication Data

US 2018/0135568 A1 May 17, 2018

(30) Foreign Application Priority Data

Nov. 15, 2016 (JP) ..... 2016-222181

(51) Int. Cl.
*F02M 26/03* (2016.01)
*F02M 26/09* (2016.01)
*F02B 39/10* (2006.01)

(52) U.S. Cl.
CPC ..... *F02M 26/03* (2016.02); *F02M 26/09* (2016.02)

(58) Field of Classification Search
CPC ..... F02M 26/03; F02M 26/07; F02M 26/09; F02B 39/00; F02B 39/10; F02B 37/013
USPC ..... 60/607–608, 605.2
See application file for complete search history.

(56) References Cited

U.S. PATENT DOCUMENTS 3,447,740 A * 6/1969 Friberg ..... F04D 25/16 415/181
4,250,711 A * 2/1981 Zehnder ..... F02B 37/00 60/605.2
4,555,904 A * 12/1985 Melzer ..... F02B 37/00 60/605.2
6,129,524 A * 10/2000 Woollenweber ..... F02B 39/10 417/366
6,945,236 B2 * 9/2005 Nakai ..... F02B 31/085 60/605.2

(Continued)

FOREIGN PATENT DOCUMENTS

CN 101341320 A 1/2009
EP 3447276 A2 * 2/2019 ..... F02M 26/03

(Continued)

*Primary Examiner* — Thai Ba Trieu
(74) *Attorney, Agent, or Firm* — Sughrue Mion, PLLC

(57) ABSTRACT

An electric supercharger includes an electric motor, a compressor wheel rotated by the electric motor, and a compressor housing. The compressor housing includes a first passage through which air is introduced, an introducing port connecting to an EGR device, a second passage through which at least one of air and EGR gas is flowed, a bypass passage through which at least one of air and EGR gas is flowed, and a bypass valve to open and close the bypass passage. When the bypass valve is opened, air introduced from the first passage and EGR gas introduced from the introducing port are flowed through the bypass passage to the internal combustion engine. When the bypass valve is closed, air introduced from the first passage and EGR gas introduced from the introducing port are compressed in the compressor wheel and flowed through the second passage to the internal combustion engine.

4 Claims, 6 Drawing Sheets

(56) References Cited

U.S. PATENT DOCUMENTS

| | | | | |
|---|---|---|---|---|
| 7,237,381 | B2 * | 7/2007 | Kolavennu | F01N 3/0807 60/608 |
| 7,503,175 | B2 * | 3/2009 | Isogai | F02B 37/005 60/605.2 |
| 7,779,634 | B2 * | 8/2010 | Barthelet | F02B 39/10 60/605.2 |
| 8,028,525 | B2 | 10/2011 | An et al. | |
| 8,495,992 | B2 * | 7/2013 | Roth | F02M 26/07 60/605.2 |
| 9,261,051 | B2 * | 2/2016 | Ulrey | F02M 26/07 |
| 9,309,836 | B2 * | 4/2016 | Ulrey | F02M 26/06 |
| 2007/0044470 | A1 * | 3/2007 | Sumser | F02B 37/16 60/605.1 |
| 2009/0031722 | A1 | 2/2009 | An et al. | |
| 2011/0302918 | A1 * | 12/2011 | Vollmer | F02M 26/07 60/605.2 |
| 2013/0074495 | A1 * | 3/2013 | Chi | F02B 37/10 60/605.2 |
| 2014/0090626 | A1 * | 4/2014 | An | F02B 39/10 29/598 |
| 2015/0047340 | A1 * | 2/2015 | Ulrey | F02D 41/0007 60/600 |
| 2015/0047618 | A1 * | 2/2015 | Ulrey | F02D 41/0007 123/568.12 |
| 2015/0345374 | A1 * | 12/2015 | Cornelius | F02B 37/16 60/605.1 |
| 2016/0348615 | A1 * | 12/2016 | Fischer | F02M 26/07 |
| 2017/0175618 | A1 * | 6/2017 | Hashimoto | F02B 37/16 |
| 2017/0276096 | A1 * | 9/2017 | Fischer | F02M 26/07 |
| 2017/0335805 | A1 * | 11/2017 | Zhang | F02M 26/07 |
| 2018/0058341 | A1 * | 3/2018 | Kuske | F02D 9/1015 |
| 2018/0328318 | A1 * | 11/2018 | Kuske | F02M 26/70 |
| 2019/0128195 | A1 * | 5/2019 | Lee | F02B 39/10 |

FOREIGN PATENT DOCUMENTS

| | | | | |
|---|---|---|---|---|
| JP | 2002332919 | A * | 11/2002 | F02M 26/06 |
| JP | 2008-038869 | A | 2/2008 | |
| JP | 2012-136957 | A | 7/2012 | |
| JP | 2018131924 | A * | 8/2018 | |
| JP | 2018193970 | A * | 12/2018 | |
| WO | WO-02068809 | A1 * | 9/2002 | F02M 26/06 |

* cited by examiner

ELECTRIC SUPERCHARGER

BACKGROUND OF THE INVENTION

The present invention relates to an electric supercharger.

Japanese Patent Application Publication No. 2008-38869 discloses a multistage supercharging type exhaust turbocharger.

The above turbocharger has a high-pressure compressor cover that is formed as an integrated compressor cover incorporating therein a compressor inlet passage for intake air and a bypass inlet passage having an opening and closing part operated by the compressor bypass valve device.

In an internal combustion engine having a conventional supercharger of another structure. EGR gas, or part of gas exhausted from the internal combustion engine, is allowed to flow through an EGR device into an intake passage in which intake air flows upstream of the supercharger so that a mixture of the intake air and the EGR gas is compressed by the supercharger and supplied to the internal combustion engine. However, an internal combustion engine having such a supercharger has a problem in that the intake passage becomes large in size and it is difficult to install the EGR device in a vehicle because the joining portion of the EGR device is provided separately from the supercharger.

The present invention which has been made in light to the above problem is directed to providing an electric supercharger that is easily installed in a vehicle.

SUMMARY OF THE INVENTION

In accordance with an aspect of the present invention, there is provided an electric supercharger including an electric motor, a compressor wheel rotated by the electric motor, and a compressor housing accommodating the compressor wheel. The compressor housing includes a first passage through which air is introduced, an introducing port connected to an EGR device that recirculates EGR gas that is part of exhaust gas of an internal combustion engine to an intake passage, a second passage through which at least one of air and EGR gas that are compressed in the compressor wheel is flowed to the internal combustion engine, a bypass passage through which at least one of air and EGR gas before being compressed in the compressor wheel is flowed to the internal combustion engine without being flowed through the compressor wheel, and a bypass valve to open and close the bypass passage. When the bypass valve is opened, air introduced from the first passage and EGR gas introduced from the introducing port are flowed through the bypass passage to the internal combustion engine. When the bypass valve is closed, air introduced from the first passage and EGR gas introduced from the introducing port are compressed in the compressor wheel and flowed through the second passage to the internal combustion engine.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
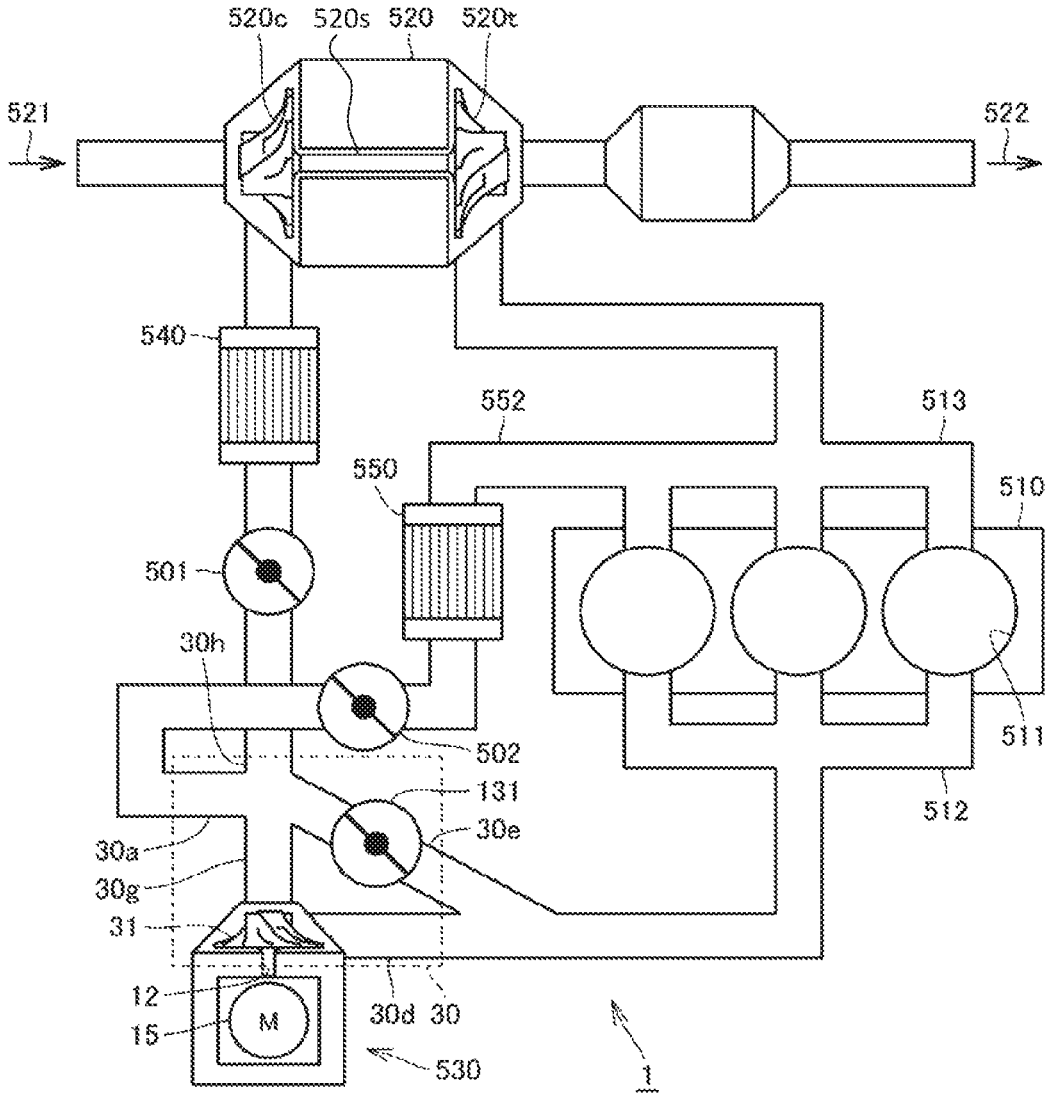
FIG. 1 is a system chart of a drive system having an electric supercharger according to a first embodiment of the present invention.

The following will describe embodiments of the present invention with reference to the accompanying drawings. Same or like parts are designated by the same reference numerals, and the description thereof will not be reiterated.

First Embodiment

The following will describe an electric supercharger 530 of a drive system 1 according to a first embodiment of the present invention with reference to FIGS. 1 to 7. Referring to FIG. 1, the drive system 1 includes an engine 510, a turbocharger 520 that is powered by exhaust gas of the engine 510 to compress intake air, and an electric supercharger 530 that further compresses the intake air sent from the turbocharger 520.

The turbocharger 520 includes a shaft 520*s*, a compressor wheel 520*c* and, a turbine wheel 520*t*. The compressor wheel 520*c* and the turbine wheel 520*t* are mounted on the shaft 520*s* at the opposite ends thereof for rotation therewith. As the turbine wheel 520*t* is rotated by exhaust gas, its rotation is transmitted to the compressor wheel 520*c* through the shaft 520*s*, so that the compressor wheel 520*c* is rotated. Air introduced in the direction of the arrow 521 is compressed by the compressor wheel 520*c*.

An intercooler 540 is provided downstream of the compressor wheel 520*c* with respect to the direction in which the air flows. The intercooler 540 cools the air that is heated by adiabatic compression by the compressor wheel 520*c* thereby to increase the density of the air.

An electronic throttle device 501 is provided downstream of the intercooler 540. When the engine 510 is a gasoline engine, the electronic throttle device 501 controls the amount of intake air to control the output power of the engine 510. When the engine 510 is a diesel engine, the valve in the electronic throttle device 501 is opened in normal operation. When exhaust gas recirculation (EGR) is performed under a light load condition or when it is desired to increase the exhaust gas temperature by reducing the intake air in the operation to regenerate a diesel particulate filter (DPF), the electronic throttle device 501 is operated to reduce the opening of its valve.

An electric supercharger 530 is provided downstream of the electronic throttle device 501. The electric supercharger 530 includes an electric motor 15, a shaft 12 connected at one end thereof to the electric motor 15, a compressor wheel 31 connected to the other end of the shaft 12, and a compressor housing 30 having therein a plurality of air passages.

The engine 510 is provided downstream of the electric supercharger 530. Air is supplied through an intake manifold 512 into each cylinder bore 511 of the engine 510. Exhaust gas is generated by combustion of fuel in the cylinder bores 511 supplied with air. The exhaust gas generated in the cylinder bores 511 are discharged through an exhaust manifold 513 to an exhaust pipe by movement of the pistons. An EGR device 552 is connected to the exhaust manifold 513 and includes an EGR valve 502 and an EGR cooler 550. When the EGR valve 502 is opened, part of exhaust gas discharged from the cylinder bores 511 to the exhaust manifold 513, or the EGR gas, is flowed to the EGR cooler 550 of the EGR device 552 to be cooled there and then introduced to the compressor housing 30. EGR gas which has the same chemical composition as exhaust gas from the engine 510 is flowed through the compressor housing 30 to the engine 510. EGR gas has no oxygen or very small amount of oxygen, if any. Therefore, when EGR gas is flowed into a combustion chamber, fuel is burnt under low oxygen condition in the combustion chamber, so that the peak combustion temperature is decreased accordingly. As a result, generation of nitrogen oxides is suppressed. The remaining part of exhaust gas discharged from the cylinder bores 511 to the exhaust manifold 513 is flowed through an exhaust pipe to the turbocharger 520 to rotate the turbine wheel 520*t* and then discharged to the atmosphere as indicated in the direction of the arrow 522 through a purification apparatus not shown.

The compressor housing 30 has therein an air passage 30*h* serving as the first passage of the present invention, an EGR passage 30*a* serving as the introducing port of the present invention, a compressor inlet passage 30*g*, a compressor outlet passage 30*d* serving as the second passage of the present invention, a bypass passage 30*e*, and a bypass valve 131.

Air is introduced into the electric supercharger 530 through the air passage 30*h*. EGR gas is introduced into the electric supercharger 530 through the EGR passage 30*a*. When the bypass valve 131 is closed, no air and no EGR gas are allowed to flow through the bypass passage 30*e*. When the bypass valve 131 is opened, air and EGR gas are allowed to flow through the bypass passage 30*e*.

At least one of the air and the EGR gas is introduced through the compressor inlet passage 30*g* to the compressor wheel 31. While the compressor wheel 31 is rotating, at least one of the air and the EGR gas is compressed by the compressor wheel 31 and discharged through the compressor outlet passage 30*d*.

Figure 2:
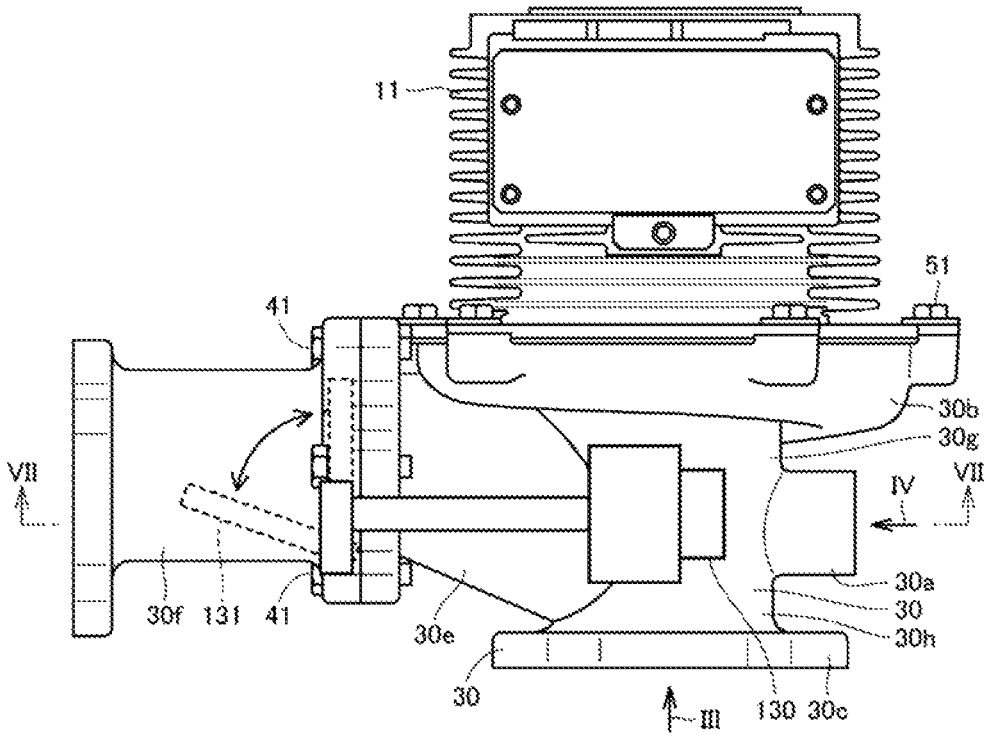
FIG. 2 is a plan view of the electric supercharger of FIG. 1.

Referring to FIG. 2, there is shown the compressor housing 30 of the electric supercharger configured to have therein a plurality of passages. The compressor housing 30 has a flange 30*c* which is connected to a pipe through which air is taken in. The air passage 30*h* is provided downstream of the flange 30*c*.

The EGR passage 30*a* is connected to the air passage 30*h*. The EGR passage 30*a* is connected to a pipe through which EGR gas is taken in. The EGR passage 30*a* is joined with the air passage 30*h*.

The compressor inlet passage 30*g* is provided downstream of the air passage 30*h* and the EGR passage 30*a*. Air supplied from the air passage 30*h* and EGR gas supplied from the EGR passage 30*a* are mixed and flowed to the compressor inlet passage 30*g*.

A scroll passage 30*b* is formed in a spiral shape around a rotating shaft of the compressor wheel 31, through which gas compressed by the compressor wheel 31 is flowed.

The bypass passage 30*e* is connected to the air passage 30*h* and the EGR passage 30*a*. The bypass valve 131 is connected to the bypass passage 30*e*.

When the bypass valve 131 is opened, at least one of the air and the EGR gas is flowed through the bypass passage 30*e*. When the bypass valve 131 is closed, at least one of the air and the EGR gas is flowed to the compressor wheel 31.

The compressor housing 30 includes an actuator 130. The actuator 130 electrically controls to open and close the bypass valve 131 and adjusts the opening degree of the bypass valve 131.

The motor housing 11 is fixed to the compressor housing 30 by bolts 51. An outlet passage 30*f* is fixed to the compressor housing 30 by bolts 41.

Figure 3:
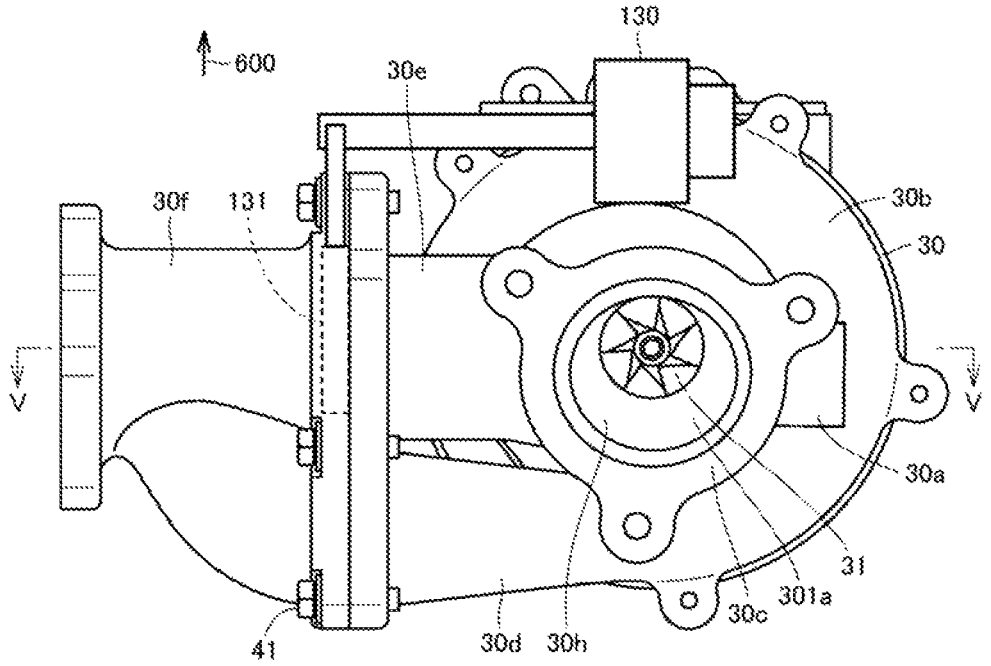
FIG. 3 is a front view of the electric supercharger as seen in the direction of the arrow III in FIG. 2.

Referring to FIG. 3, the scroll passage 30*b* has such a spiral shape that its passage diameter is increased toward the connection thereof with the cutlet passage 30*f*.

The bypass passage 30*e* is disposed with the inlet opening thereof facing the EGR passage 30*a* along the extending direction of the EGR passage 30*a* so that EGR gas supplied through the EGR passage 30*a* is smoothly flowed via the air passage 30*h* into the bypass passage 30*e*. Accordingly, when the bypass valve 131 is opened, EGR gas is easy to flow from the EGR passage 30*a* to the bypass passage 30*e*.

The outlet passage 30*f* is connected to both the bypass passage 30*e* and the compressor outlet passage 30*d*, The outlet passage 30*f* has such a bifurcated shape that the above two passages are joined with each other.

The compressor outlet passage 30*d* having a straight shape is connected to the downstream-most portion of the scroll passage 30*b*.

Figure 4:
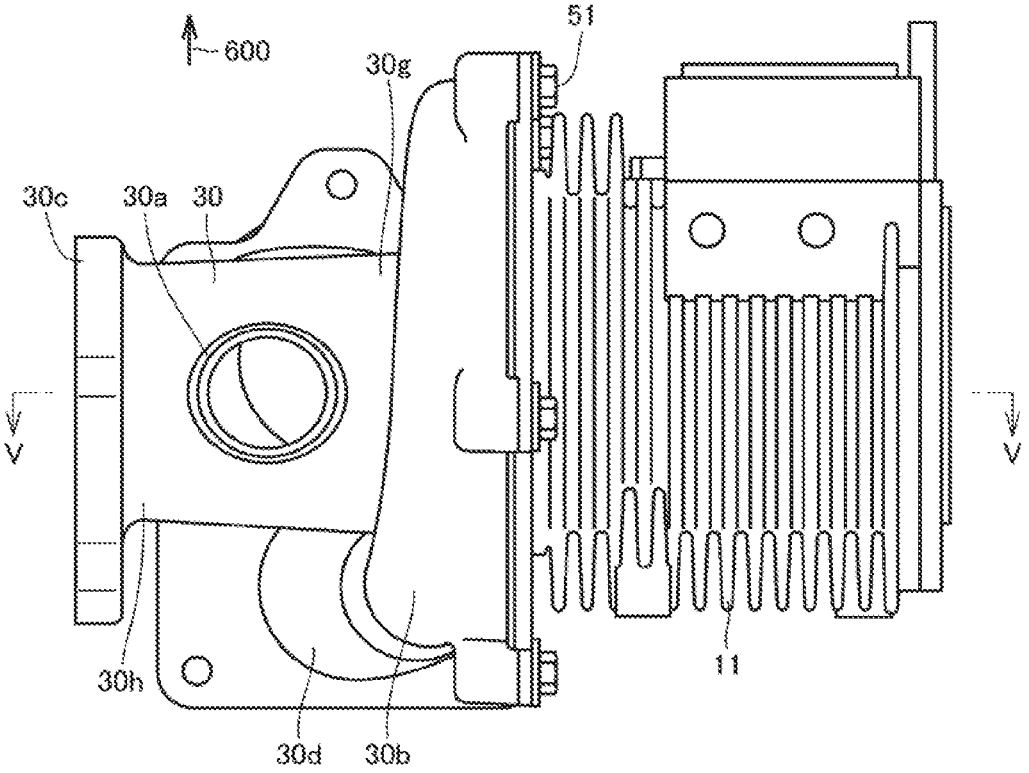
FIG. 4 is a right side view of the electric supercharger as seen in the direction of the arrow IV in FIG. 2.

Referring to FIG. 4, the EGR passage 30*a* having a cylindrical shape is connected to the air passage 30*h* and the compressor inlet passage 30*g*.

Figure 5:
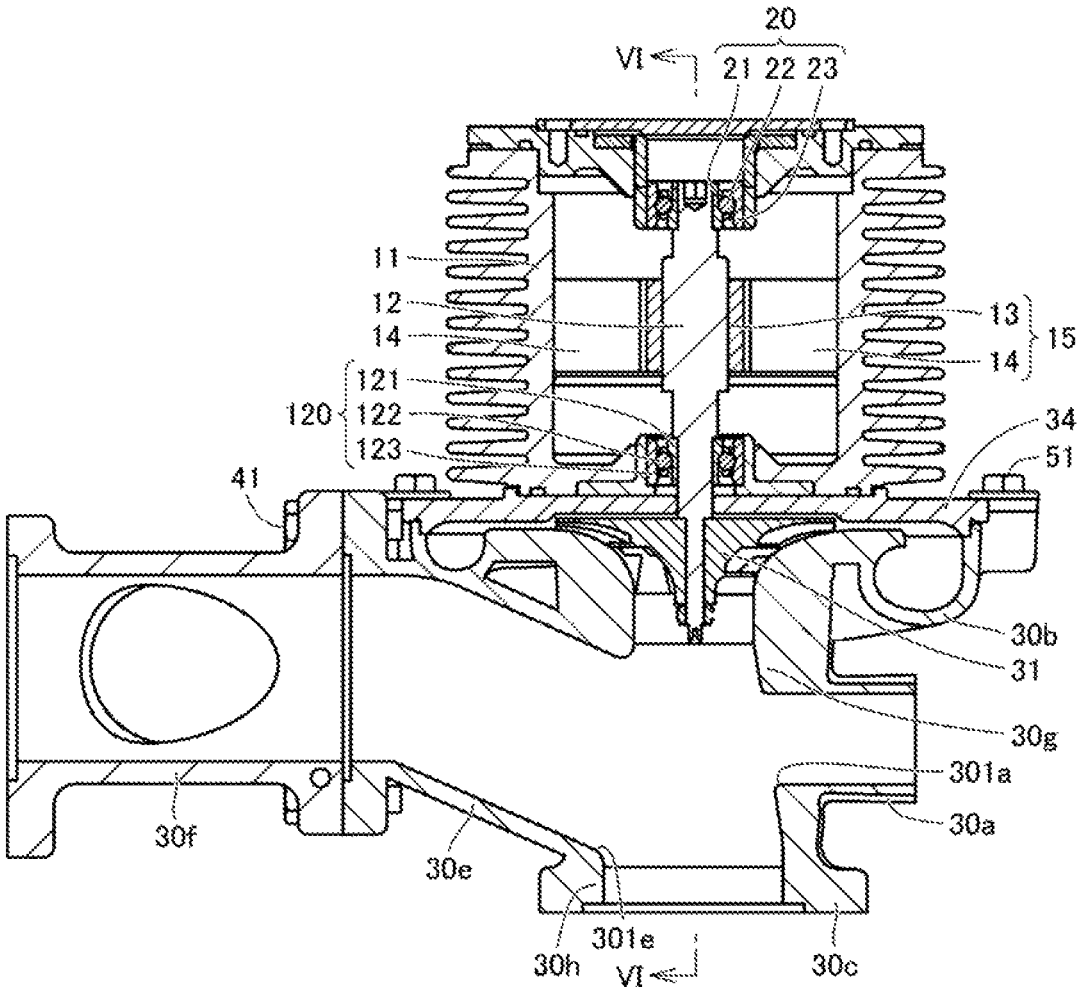
FIG. 5 is a sectional view taken along the line V-V of FIG. 4.

Referring to FIG. 5, the electric motor 15 includes a rotor 13 fixed on a shaft 12 and a stator 14 disposed facing the rotor 13. The electric motor 15 is supplied with electric power and drives to rotate the shaft 12.

The shaft 12 extends from one end thereof to the other end thereof. The shaft 12 is rotatably supported at one end thereof by a bearing 20 and at one other end thereof by a bearing 120 in the motor housing 11. The shaft 12 has a stepped shape having a plurality of different diameter portions in the longitudinal direction thereof.

The rotor 13 is fixed on the thickest portion of the shaft 12. When the electric motor 15 is a three-phase AC motor, the rotor 13 includes a core and a permanent magnet that is embedded in the core.

The bearings 20, 120 are provided on the shaft 12 on the opposite sides of the rotor 13. The bearings 20, 120 are provided by ball bearings. Each of the bearings 20, 120 includes an inner race 21, 121 disposed in contact with the shaft 12, the outer race 23, 123 disposed facing the inner race 21, 121, a plurality of balls 22, 122 disposed between the inner race 21, 121 and the outer race 23, 123 as the rolling element, and a retainer retaining the balls 22, 122.

The compressor wheel 31 is fixed on the other end of the shaft 12 and compresses intake air. Intake air including the air and the EGR gas is drawn in from the air passage 30*h* by the rotation of the compressor wheel 31. The flowing speed of the intake air flowing through the compressor wheel 31 is increased by the centrifugal force of the rotating compression wheel 31 and the pressure of the intake air is increased in the diffuser portion of the compressor housing 30 and the scroll passage 30*b*, accordingly.

A plate 34 is provided between the compressor wheel 31 and the motor housing 11. The plate 34 is disposed on the back side of the compressor wheel 31 and fixed to the compressor housing 30 by the bolts 51. The plate 34 has at the center thereof a hole through which the shaft 12 is inserted. The plate 34 and the compressor housing 30 cooperate to form the diffuser portion and the scroll passage 30*b*.

The compressor housing 30 is provided so as to cover the compressor wheel 31. The compressor housing 30 has therein the compressor inlet passage 30*g*. At least one of the air and the EGR gas is introduced through the compressor inlet passage 30*g* to the compressor wheel 31 to be compressed in the compressor wheel 31 and flowed to the compressor outlet passage 30*d*.

Figure 6:
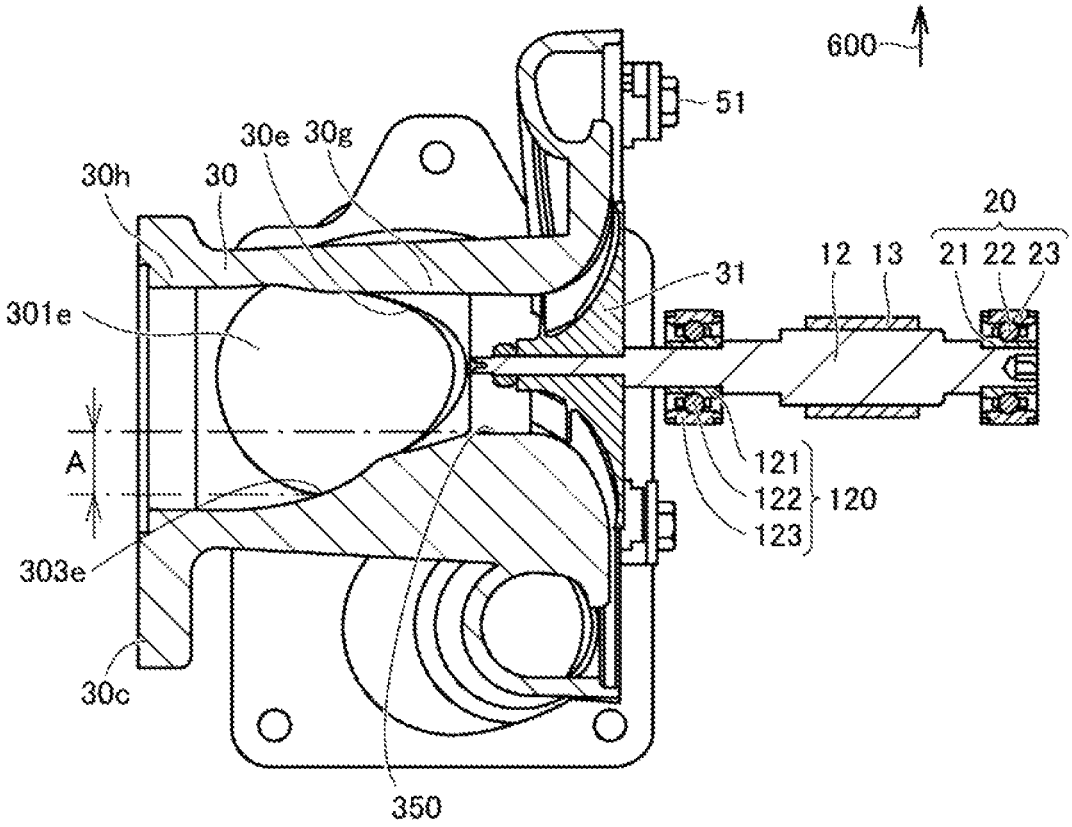
FIG. 6 is a sectional view taken along the line VI-VI of FIG. 5.

Referring to FIG. 6, in which illustration of the stator 14 and the motor housing 11 around the shaft 12 are omitted, the lower end 303*e* of the inlet 301*e* in the bypass passage 30*e* is offset vertically downward relative to the lower end 350 of the inlet side opening of the compressor wheel 31 by a distance which is indicated by A.

The arrow 600 shown in FIG. 6 and other similar drawings indicates the upper direction. The downward offset of the bypass passage 30*e* makes difficult for moisture in the bypass passage 30*e* to flow toward the compressor inlet passage 30*g*, which helps to prolong the serviceable life of the electric supercharger.

Figure 7:
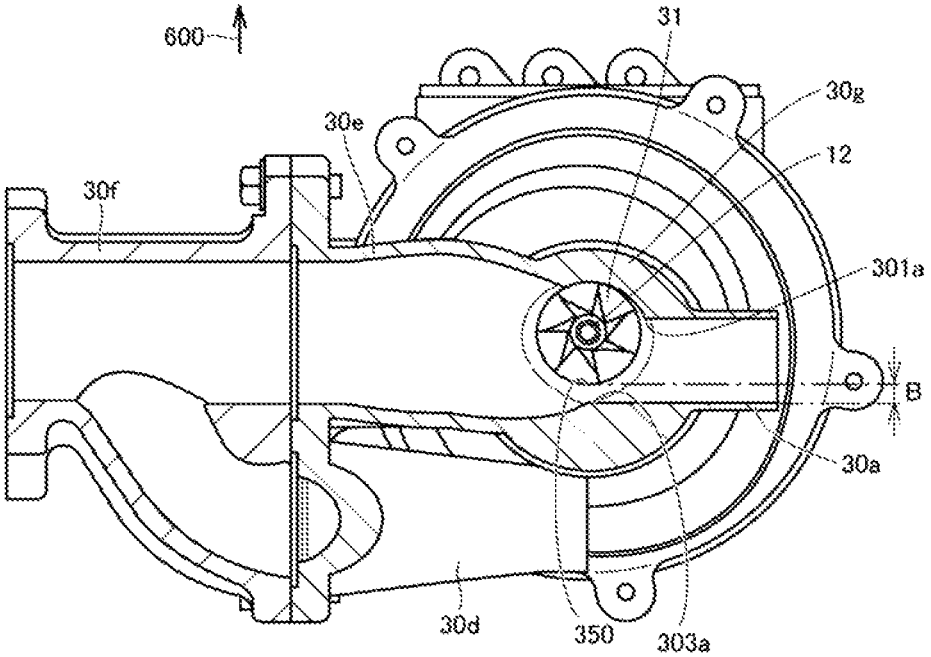
FIG. 7 is a sectional view taken along the line VII-VII of FIG. 2.

Referring to FIG. 7, the lower end 303*a* of the EGR passage 30*a* is offset vertically downward relative to the lower end 350 of the inlet side opening of the compressor wheel 31 by a distance which is indicated by B.

The exhaust gas supplied to the EGR device may contain moisture. If EGR gas flows through the introducing port toward the compressor wheel, the moisture that has a greater specific gravity than the other components contained in the EGR gas hardly flows toward the compressor wheel because of the vertical downward offset of the introducing port of EGR gas relative to the lower end of the inlet side opening of the compressor wheel, with the result that the mixture of moisture and intake air is suppressed.

The downward offset of the EGR passage 30*a* makes difficult for moisture of the EGR passage 30*a* to flow toward the compressor inlet passage 30*g*, which helps to prolong the serviceable life of the electric supercharger.

In the present embodiment, the EGR passage 30*a* is shown having a predetermined length. However, it may be so configured that the length of the EGR passage 30*a* is shorter or, alternatively, substantially zero so that only the introducing port 301*a* exists. In this case, a pipe is inserted in the introducing port 301*a* so that EGR gas is supplied through the pipe to the introducing port 301*a*. In the present embodiment, the shaft 12 of the supercharger 530 has a plurality of different diameter portions. However, the shaft 12 may be formed with a constant diameter.

The electric supercharger 530 includes the compressor wheel 31 rotatable by the electric motor 15 and the compressor housing 30 accommodating the compressor wheel 31. The compressor housing 30 has therein the air passage 30*h* through which air is introduced, the EGR passage 30*a* connected to the EGR device 552 that recirculates EGR gas, or part of the exhaust gas generated by the engine 510 to an intake passage, the compressor outlet passage 30*d* through which at least one of the air and the EGR gas compressed by the compressor wheel 31 is flowed to the engine 510, the bypass passage 30*e* through which at least one of the air and the EGR gas before being compressed is flowed to the engine 510 without being flowed through the compressor wheel 31, and the bypass valve 131 that opens and closes the bypass passage 30*e*. When the bypass valve 131 is opened, the air introduced from the air passage 30*h* and the EGR gas introduced through the EGR passage 30*a* are allowed to flow to the engine 510 via the bypass passage 30*e*. When the bypass valve 131 is closed, the air introduced from the air passage 30*h* and the EGR gas introduced through the EGR passage 30*a* are compressed by the compressor wheel 31 and allowed to flow to the engine 510 via the compressor outlet passage 30*d*. Since the air passage 30*h*, the EGR passage 30*a*, and the bypass passage 30*e* are provided in the singular compressor housing 30, the structure of parts other than the compressor housing 30 can be simplified and, therefore, the installation of the electric supercharger 530 to the engine 510 may be facilitated as compared with a structure having no compressor housing such as 30.

The lower end 303*a* of the EGR passage 30*a* is offset vertically downward relative to the lower end 350 of the inlet side opening of the compressor wheel 31, which prevents water in the EGR passage 30*a* from flowing toward the compressor wheel 31.

The lower end 303*e* of the inlet 301*e* of the bypass passage 30*e* is offset vertically downward relative to the lower end 350 of the inlet side opening of the compressor wheel 31. Therefore, water in the EGR passage 30*a* is prevented from flowing toward the compressor wheel 31.

Second Embodiment

Figure 8:
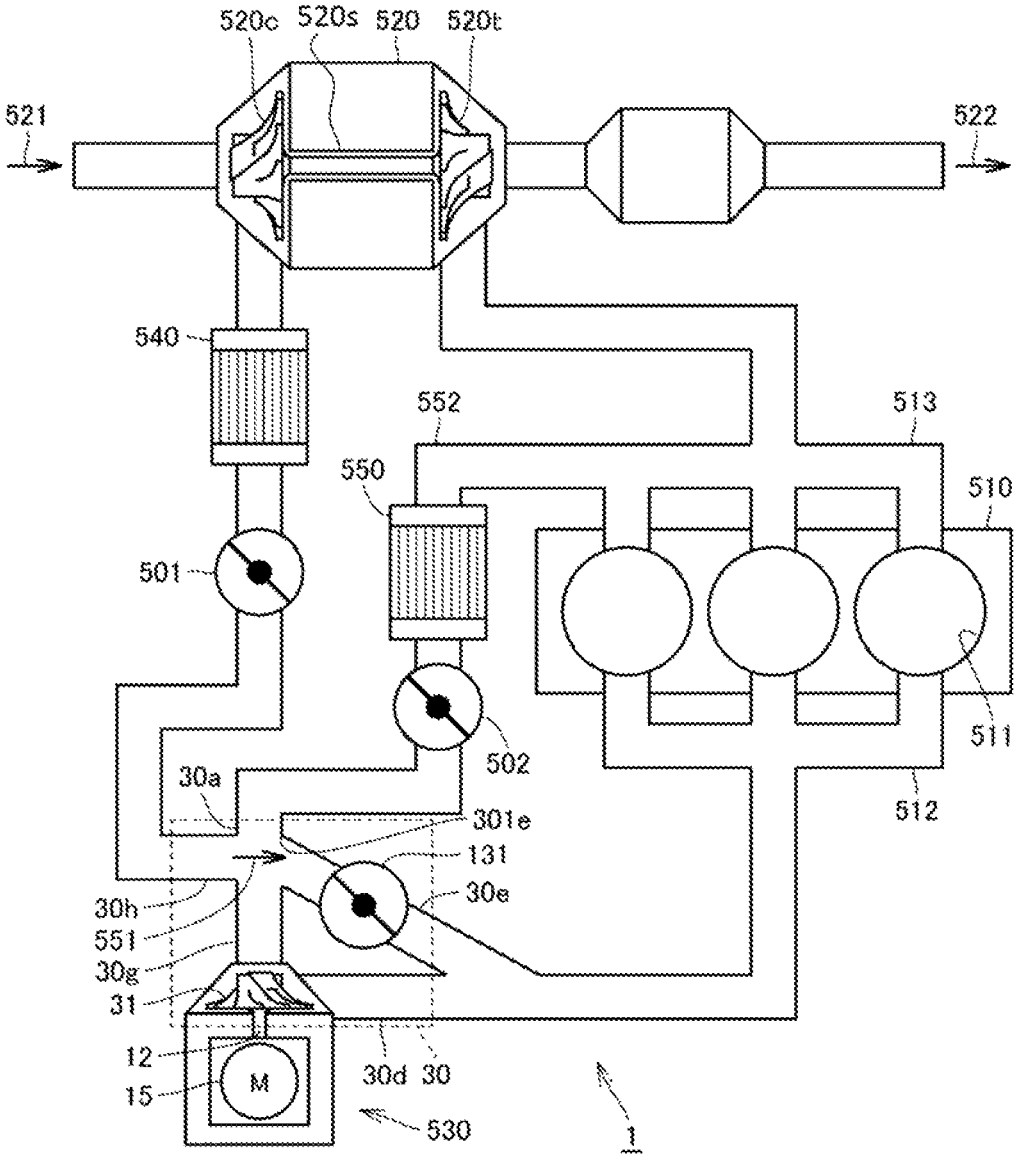
FIG. 8 is a system chart of a drive system having an electric supercharger according to a second embodiment of the present invention.

Referring to FIG. 8, there is shown an electric supercharger 530 according to a second embodiment of the present invention. The second embodiment differs from the first embodiment in that the air passage 30*h* is provided in the compressor housing 30 so as to face the inlet 301*e* of the bypass passage 30*e* in the extending direction of the air passage 30*h*. As with the first embodiment, the lower end 303*a* of the EGR passage 30*a* is offset vertically downward relative to the lower end 350 of the inlet side opening of the compressor wheel 31. The lower end 303*e* of the inlet 301*e* of the bypass passage 30*e* is also offset vertically downward relative to the lower end of the 350 of the inlet side opening of the compressor wheel 31.

In the electric supercharger 530 according to the second embodiment, air is flowed from the air passage 30*h* to the bypass passage 30*e* in the direction of the arrow 551 in a nearly straight manner, so that the resistance of air flowing from the air passage 30*h* to the bypass passage 30*e* and hence the air intake resistance can be reduced.

The present examples and embodiments are to be construed as illustrative and not restrictive, and the invention is not to be limited to the details given herein but may be modified within the scope of the present invention.

The present invention can be is applicable to an electric supercharger mounted on a vehicle.

What is claimed is:

1. An electric supercharger comprising:

an electric motor;

a compressor wheel rotated by the electric motor;

an actuator; and a compressor housing which covers and accommodates the compressor wheel therein, the compressor housing further including:

a first passage configured to have aft is introduced therein;

an introducing port configured to be connected to an EGR device configured to recirculate EGR gas, that is part of exhaust gas of an internal combustion engine, to an intake passage;

a second passage configured to have at least one of air and EGR gas, that are compressed in the compressor wheel, flowed therethough to the internal combustion engine;

a bypass passage configured such that at least one of air and EGR gas, before being compressed in the compressor wheel, flows therethrough to the internal combustion engine without being flowed through the compressor wheel; and a bypass valve electrically controlled by the actuator to open and close the bypass passage;

wherein, when the bypass valve is opened, aft introduced from the first passage and EGR gas introduced from the introducing port are flowed through the bypass passage to the internal combustion engine; and wherein, when the bypass valve is closed; aft introduced from the first passage and EGR gas introduced from the introducing port are compressed in the compressor wheel and flowed through the second passage to the internal combustion engine.

2. The electric supercharger according to claim 1, wherein a lower end of the introducing port is offset vertically downward relative to a lower end of an inlet side opening of the compressor wheel.

3. The electric supercharger according to claim 1, wherein a lower end of an inlet of the bypass passage is offset vertically downward relative to the lower end of the inlet side opening of the compressor wheel.

4. The electric supercharger according to claim 1, wherein the first passage is provided in the compressor housing so as to face an inlet of the bypass passage in an extending direction of the first passage.

* * * * *